United States Patent [19]

McCausland

[11] Patent Number: 4,873,674

[45] Date of Patent: Oct. 10, 1989

[54] CORROSION RESISTANT BRONZE ALLOYS AND GLASS MAKING MOLD MADE THEREFROM

[75] Inventor: Thomas W. McCausland, Brockway, Pa.

[73] Assignee: O-I Brockway Glass, Inc., Toledo, Ohio

[21] Appl. No.: 315,104

[22] Filed: Feb. 24, 1989

[51] Int. Cl.[4] ..... C22C 9/06; C03B 11/00

[52] U.S. Cl. ..... 65/374.12; 249/135; 420/486; 420/487

[58] Field of Search ..... 65/374.12; 420/486, 420/487, 488; 249/135

[56] References Cited

U.S. PATENT DOCUMENTS 4,436,544 3/1984 McCausland ..... 65/374.12

4,732,602 3/1988 Dakan et al. ..... 65/374.12

*Primary Examiner*—Robert L. Lindsay

[57] ABSTRACT

A bronze alloy composition for glass making molds that has excellent corrosion resistance and resistance to pitting, the composition comprising copper, aluminum, nickel, iron, manganese, and a critical amount of silicon to provide the resistance to pitting.

11 Claims, No Drawings

CORROSION RESISTANT BRONZE ALLOYS AND GLASS MAKING MOLD MADE THEREFROM

The present invention relates to a corrosion resistant bronze alloy that is resistant to pitting when contacted by hot glass. The invention also relates to glass making molds and mold members and a method of making the same using the bronze alloys.

BACKGROUND OF THE INVENTION

The McCausland U.S. Pat. No. 4,436,544 discloses an aluminum bronze alloy composition for glass making molds and mold members. The alloy compositions are made of aluminum, nickel, manganese and iron, with the balance being copper. Alloys 3 and 4 of Table 1 (col. 3) are shown to contain the following ingredients in percent by weight:

| | Alloy 3 | Alloy 4 |
|---|---|---|
| Aluminum | 8.0–14.0 | 8.0–14.0 |
| Nickel | 2.0–10.0 | 2.0–10.0 |
| Iron | 0.1–6 | 0.1–6.0 |
| Manganese | 3.1–5 | 6.1–8.0 |
| Copper | 67.0–85.0 | 66.0–84.0 |

Alloys 3 and 4 and other alloys disclosed in the McCausland patent have many desirable properties including very high thermal conductivities.

The McCausland U.S. Pat. No. 4,436,544 is hereby incorporated by reference.

It is desirable to have bronze alloys for glass making molds and mold members that have the good balance of properties of the alloys of the above mentioned McCausland patent, with even better corrosion resistance, especially with a reduction in pitting and a lower thermal conductivity.

OBJECTS OF THE INVENTION

It is an object of the invention to provide a new bronze alloy with superior properties of resistance to especially resistance to pitting, the bronze alloy glass making molds and mold members being made from a bronze alloy composition comprising the following metals in approximate weight percent:

| Metal | Percent by Weight |
|---|---|
| Aluminum | 8–12 |
| Nickel | 12–18 |
| Iron | 1–6 |
| Manganese | 1.5–6 |
| Silicon | 0.1–2 |
| Copper | the balance, preferably 64–84 |

It is an object of the present invention to provide a method of making a glass making mold member, the method comprising: forming the mold member from a bronze alloy composition consisting essentially of the following ingredients in approximate percent by weight:

| Ingredients | Percent by Weight |
|---|---|
| Aluminum | 8–12 |
| Nickel | 12–18 |
| Iron | 1–6 |
| Manganese | 0.5–6 |

-continued

| Ingredients | Percent by Weight |
|---|---|
| Silicon | 0.1–2.0 |
| Copper | balance |

These and other objects of the invention will be apparent from the specification that follows and the appended claims.

SUMMARY OF THE INVENTION

The present invention provides an aluminum bronze alloy for glassmaking molds, the alloy having the following ingredients in approximate percent by weight:

| | BG 650 |
|---|---|
| Aluminum (%) | 8.0–12.0 |
| Nickel (%) | 12.0–18.0 |
| Iron (%) | 1.0–6.0 |
| Manganese (%) | 0.5–6.0 |
| Silicon (%) | 0.1–2.0 |
| Copper | balance |

and the alloy having the following properties:

| | |
|---|---|
| Tensile Strength (psi) | 75,000–100,000 |
| Yield Strength (psi) | 35,000–60,000 |
| Elongation (%) | 1.0–6.0 |
| Hardness (BHN) | 175–250 |
| Thermal Conductivity | 36–40 |

at 850° F. (BTU/hr/ft$^2$/ft/°F.), the alloy being corrosion resistant and resistant to pitting from contact with hot glass.

The present invention also provides a bronze alloy glassmaking mold, the alloy having the following ingredients in approximate percent by weight:

| Ingredients | BG 650 |
|---|---|
| Aluminum (%) | 8.0–12.0 |
| Nickel (%) | 12.0–18.0 |
| Iron (%) | 1.0–6.0 |
| Manganese (%) | 0.5–6.0 |
| Silicon (%) | 0.1–2.0 |
| Copper (%) | balance |
| Tensile Strength (psi) | 75,000–100,000 |
| Yield Strength (psi) | 35,000–60,000 |
| Elongation (%) | 1.0–6.0 |
| Hardness (BHN) | 175–250 |
| Thermal Conductivity | 36–40 |

at 850° (BTU/hr/ft$^2$/ft/°F.), the alloy being corrosion resistant and resistant to pitting from contact with hot glass.

The present invention also provides a process of making glass making mold members from the aforementioned bronze alloy composition containing a critical amount of about 0.1 to 2 weight percent, based on the total alloy composition, of silicon.

In the preferred embodiment of the invention, the amount of silicon is about 0.3 to 1 weight percent of the total alloy, the alloy composition containing the following elements in approximate weight percent:

| Element | Percent by Weight |
|---|---|
| Aluminum | 8–11 |
| Nickel | 14–16 |

-continued

| Element | Percent by Weight |
|---|---|
| Iron | 3–4 |
| Manganese | 0.6–5 |
| Silicon | 0.3–1.0 |
| Copper | balance |

The bronze alloy of the present invention has many glass making equipment uses and it has many advantages as follows:

(1) It has improved corrosion resistance. This means glass mold equipment made from it will last longer in corrosive environments, such as those caused by sulphur. With this alloy, the environment can be made more corrosive to help improve bottle making productivity.

(2) It can easily be weld repaired because it does not contain zinc or lead.

(3) It has improved bearing properties, thus reducing galling of mold parts.

(4) It has a metallurgical structure that is not easily altered when exposed to heat; thus mold equipment made from this alloy has good dimensional stability.

(5) It has a fine grain structure that can be achieved without the use of metal chillers.

(6) It has a relatively high hardness and low ductility which enables mold equipment to resist wear and impact damage.

(7) Although the alloy is relatively hard, it has acceptable machinability.

(8) It has a thermal conductivity similar to that of the bronze alloys presently being used in the industry. This means glass mold equipment made from it will be compatible with current practices.

(9) It can be used in the heat treated or as-cast conditions.

(10) It can be produced in the foundry by blending together pure elements or those that have been combined for alloying purposes. This is the most economical way to produce most all alloys. Those glass mold alloys which contain zinc cannot be easily made this way due to safety reasons.

The following examples illustrate the present invention, the bronze alloys made according to McCausland U.S. Pat. No. 4,436,544 except that a critical amount (0.1–2 weight percent) of silicon is used to provide superior corrosion resistance.

EXAMPLE 1

Bronze alloys were made and cast to form glass making molds, the alloy composition being shown in Table I, alloy B (containing 0.5 wt% silicon) being an alloy of the present invention. Tests were made and the resultant corrosion resistance is shown in Table II and Table III. In Table III the alloy samples were heat treated at 1650° for two hours and then cooled to room temperature before heating and testing.

Table I, II and III are as follows:

Chemical Compositions and Hardnesses of Bronze Alloys

| Alloy | Al (%) | Ni (%) | Fe (%) | Mn (%) | Si (%) |
|---|---|---|---|---|---|
| A | 8.4 | 14.1 | 4.1 | 0.6 | — |
| B | 8.5 | 13.8 | 4.4 | 0.6 | 0.5 |

| Alloy | Cu (%) | As Cast Hardness ($R_B$) | Heat Treated Hardness ($R_B$) |
|---|---|---|---|
| A | Base | 93 | 90 |
| B | Base | 95 | 89 |

*Samples were heated to 1650° for two hours and slow cooled.

TABLE II

Relative corrosion resistance of as-cast bronze samples after being heated for 24 hours at the temperatures indicated

| Alloy | 1100° F. | 1200° F. | 1300° F. | Average |
|---|---|---|---|---|
| A | 3.0 | 2.5 | 4.0 | 3.2 |
| B | 1.5 | 2.0 | 2.0 | 1.8 |

Explanation of code:
1.0 No pits - Excellent surface
2.0 A few small pits - Acceptable surface
3.0 More pits - Probably not acceptable surface
4.0 Many pits - Unacceptable surface

TABLE III

Relative corrosion resistance of as-cast bronze samples that were heated to 1650° F. for two hours, slow cooled to room temperature and then reheated for 24 hours at the temperatures indicated.

| Alloy | 1100° F. | 1200° F. | 1300° F. | Average |
|---|---|---|---|---|
| A | 3.0 | 4.0 | 4.0 | 3.7 |
| B | 1.0 | 2.0 | 3.0 | 2.0 |

Explanation of code:
1.0 No pits - Excellent surface
2.0 A few small pits - Acceptable surface
3.0 More pits - Probably not acceptable surface
4.0 Many pits - Unacceptable surface

EXAMPLE II

Excellent results, including superior resistance to pitting comparable to alloy B was obtained by the following alloy composition in approximate percent by weight:

| | |
|---|---|
| Aluminum | 8.5 |
| Nickel | 15.0 |
| Iron | 4.6 |
| Manganese | 0.6 |
| Silicon | 0.3 |
| Copper | balance |

The new alloy compositions of the present invention are obtained only when the critical range of about 0.1 to 2 weight percent of silicon is used, the properties falling off at the lower end and the higher end of the range.

The Kelly Machine & Foundry U.S. Pat. No. 4,732,602 discloses a copper base alloy containing copper, nickel and aluminum, the nickel being 12–16 wt% and the aluminum being 8.5–11.5 wt%. Niobium and iron (up to 1 wt%) can be used. The patent indicates that small amounts of impurities are typically found in copper, the impurities including Sn, Pb, Zn, Sb, Si, S, P, Fe, Mn and Nb. The amount of Si by way of impurities is very low, generally about less than 0.01 wt% or 0.04 wt% (Examples 14 and 15). Such low amounts of Si do not provide the new alloy of the present invention with the critical range of Si deliberately included in the alloy rather than being present possibly only as an impurity.

What is claimed is:

1. An aluminum bronze alloy for glassmaking molds, the alloy having the following ingredients in approximate percent by weight:

| | BG-650 |
|---|---|
| Aluminum (%) | 8.0–12.0 |
| Nickel (%) | 12.0–18.0 |
| Iron (%) | 1.0–6.0 |
| Manganese (%) | 0.5–6.0 |
| Silicon (%) | 0.1–2.0 |
| Copper | balance |

and the alloy having the following properties:

| | |
|---|---|
| Tensile Strength (psi) | 75,000–100,000 |
| Yield Strength (psi) | 35,000–60,000 |
| Elongation (%) | 1.0–6.0 |
| Hardness (BHN) | 175–250 |
| Thermal Conductivity | 36–40 |

at 850° F. (BTU/hr/ft$^2$/ft/°F.), the alloy being corrosion resistant and resistant to pitting from contact with hot glass.

2. A bronze alloy glassmaking mold, the alloy having the following ingredients in approximate percent by weight:

| Ingredient | BG-650 |
|---|---|
| Aluminum (%) | 8.5–12.0 |
| Nickel (%) | 12.0–18.0 |
| Iron (%) | 1.0–6.0 |
| Manganese (%) | 0.5–6.0 |
| Silicon (%) | 0.1–2.0 |
| Copper (%) | balance |
| Tensile Strength (psi) | 75,000–100,000 |
| Yield Strength (psi) | 35,000–60,000 |
| Elongation (%) | 1.0–6.0 |
| Hardness (BHN) | 175 250 |
| Thermal Conductivity | 36 40 |

at 850° F. (BTU/hr/ft$^2$/ft/°F.) the alloy being corrosion resistant and resistant to pitting from contact with hot glass.

3. An alloy as defined in claim 1 having the following ingredients in approximate percent by weight:

| | |
|---|---|
| Aluminum | 9–11 |
| Nickel | 14–16 |
| Iron | 3–4 |
| Manganese | 0.6–4 |
| Silicon | 0.3–1.0 |
| Copper | balance |

4. An alloy as defined in claim 1 having the following ingredients in approximate percent by weight:

| | |
|---|---|
| Aluminum | 8.5 |
| Nickel | 15.0 |
| Iron | 4.6 |
| Manganese | 0.6 |
| Silicon | 0.3 |
| Copper | balance |

5. An alloy mold as defined in claim 2 having the following ingredients in approximate percent by weight:

| | |
|---|---|
| Aluminum | 9–11 |
| Nickel | 14–16 |
| Iron | 3–4 |
| Manganese | 0.6–4 |
| Silicon | 0.3–1.0 |
| Copper | balance |

6. An alloy mold as defined in claim 2 having the following ingredients in approximate percent by weight:

| | |
|---|---|
| Aluminum | 8.5 |
| Nickel | 15.0 |
| Iron | 4.6 |
| Manganese | 0.6 |
| Silicon | 0.3 |
| Copper | balance |

7. A glass making mold part made with the bronze alloy defined in claim 1.

8. A glass making mold part made with the bronze alloy defined in claim 3.

9. In a glassware forming machine having at least one glassmaking mold member, at least one of the mold members made from the alloy defined in claim 1.

10. A method of making a glass making mold member, the method comprising: forming the mold member from a bronze alloy composition consisting essentially of the following ingredients in approximate percent by weight:

| Ingredients | Percent by weight |
|---|---|
| Aluminum | 8–12 |
| Nickel | 12–18 |
| Iron | 1–6 |
| Manganese | 0.5–6 |
| Silicon | 0.1–2.0 |
| Copper | balance |

11. A method as defined in claim 10 in which there is a further step of heating the alloy mold member to about 1550° to 1700° F. to improve machinability without substandard reduction of resistance to pitting.

* * * * *